United States Patent [19]

Horsewell et al.

[11] 4,300,577

[45] Nov. 17, 1981

[54] TOBACCO-SMOKE FILTERS

[75] Inventors: Henry G. Horsewell, Totton; James W. P. Phelpstead, Southampton, both of England

[73] Assignee: British-American Tobacco Company Limited, London, England

[21] Appl. No.: 38,013

[22] Filed: May 11, 1979

[30] Foreign Application Priority Data

May 16, 1978 [GB] United Kingdom ..... 19977/78

[51] Int. Cl.[3] ..... A24D 3/12

[52] U.S. Cl. ..... 131/334

[58] Field of Search ..... 131/10 R, 10.3, 10.5, 131/10.7, 10.9, 262 A–269

[56] References Cited

U.S. PATENT DOCUMENTS

| | | | |
|---|---|---|---|
| 3,550,600 | 12/1970 | Horsewell et al. | 131/267 |
| 4,156,431 | 5/1979 | Epstein et al. | 131/265 |

FOREIGN PATENT DOCUMENTS

| | | | |
|---|---|---|---|
| 1570621 | 5/1969 | France | 131/10 R |
| 542106 | 4/1956 | Italy | 131/262 A |

*Primary Examiner*—V. Millin

*Attorney, Agent, or Firm*—Kane, Dalsimer, Kane, Sullivan & Kurucz

[57] ABSTRACT

A tobacco-smoke filter comprises in admixture or close dispersion a first component which is a ready but weak or weakly retentive adsorbent for vapor-phase constituents, including aldehydes, of tobacco smoke, and a second component comprising amino groups, of which at least 30% are preferably primary groups, and being capable of chemically combining with said constituents to give substantially non-volatile reaction products. Suitably the first component may comprise a porous mineral earth, such as magnesium silicate or silica gel in porous granular form. The second component may comprise an ion-exchange resin or polyethylene imine. The second component may be carried upon a porous particulate material or carried or grafted upon a fibrous material or dispersed in a fibrous material carrying the second material in a dispersed condition. Alternatively, a mixture of granular first and second components may be dispersed in a fibrous or filamentary material or disposed between plugs of such material.

12 Claims, No Drawings

TOBACCO-SMOKE FILTERS

This invention concerns improvements relating to filters for tobacco smoke, especially though not exclusively to cigarette filters.

The invention provides a tobacco-smoke filter comprising in admixture or close dispersion a first component which is a ready but weak or weakly retentive adsorbent for vapour-phase constituents, including aldehydes, of tobacco smoke, and a second component comprising amino groups and being capable of chemically combining with said constituents to give substantially non-volatile reaction products, whereby, when tobacco smoke passes through said filter in intermittent puffs, said constituents will be adsorbed by said first component during puffs and, during inter-puff periods, will desorb from said first component and chemically combine with said second component to give said substantially non-volatile reaction products. Preferably, of the amino groups of the second component, at least 30% of these are primary groups. If desired substantially all of the amino groups may be primary groups.

It has been found that filters made in accordance with the invention are capable of removing from tobacco smoke a higher proportion of volatile aldehydes and hydrogen cyanide than would be expected from the individual performances of the first and second components. The removal mechanism is believed to be as follows: During each puff, both first and second components take up vapour-phase constituents from the smoke, but, during inter-puff periods, the vapour-phase constituents which have been taken up by the first component desorb therefrom. A proportion of the desorbed vapour-phase constituents then combines, substantially permanently, with the chemically active second component. Since the rate of desorption from the first component is proportional to the concentration of the vapour-phase constituents in space adjacent the first component, their removal from that space by the substantially permanent combination with the chemically active second component produces a concentration gradient which results in a rapid depletion of the amount of vapour-phase constituents held by the first component. Thus by the time the next puff commences, the first component will be available for further effective adsorption of vapour-phase constituents. The mechanism may be regarded as involving a "pumping" effect.

Heretofore, in tobacco-smoke filters, it has been known to use chemically active adsorbents for removing vapour-phase constituents, but a problem that has been met with is the difficulty of providing suitable conditions for reactions to occur sufficiently rapidly to achieve effective removal of those constituents. The present invention is believed to avoid the problem by reason of the fact that, in the mechanism described above, the first component, or physical adsorbent, acts in the manner of a temporary "store" for the said constituents.

The first component may be selected from, for example, one or more of the following materials: porous mineral earths such as magnesium silicate in the form of meerschaum or sepiolite, macroreticular polymers, silica gel and alumina. Two forms of silica gel which have been found to give an acceptable performance are marketed under the designation "Sorbsil" U30 and "Sorbsil" ID Gel I by Joseph Crosfield Limited. Preferably, the first component is of a porous, granular nature. As indicated above, the material or materials selected as the first component must be such that in admixture with the second component, or dispersion, the vapour-phase constituents are adsorbed by the first component during puffs and, during inter-puff periods, the adsorbed constituents are yielded up for combination with the second component.

Carbon is to be classed as a relatively strong adsorbent for vapour-phase constituents in tobacco smoke and is not to be used as the first component or to constitute a major constituent thereof.

The second chemical component may, for example, be an ion-exchange resin such as that available under the designation "Duolite" A-2, A-7 (e.g. GPA 327) from Diamond Shamrock Chemical Company or that marketed under the designation "Lewatit" OC1037 (e.g. "Lewatit" E372/74) by Bayer A. G. A suitable amino-type anion-exchange resin is that used in the filter claimed in our U.S. Pat. No. 4,033,361. Other ion-exchange resins which have proved to give good results are marketed under the trade name "Diaion" with designations CR 20 and WA 21 by Mitsubishi Chemical Industries. Alternatively, the second component may be polyethylene imine impregnated upon a carrier of porous particulate material or carried by a fibrous material such as paper or cellulose acetate. The second component may be provided by two or more materials. It is a feature of substances suitable for use as the second component that they comprise material of high specific surface area, which material serves to expose the active chemical function to the smoke stream.

It is envisaged that, in a particular tobacco-smoke filter according to this invention, the first component may be of a granular nature and be dispersed in the second component, which second component comprises or also comprises a fibrous or filamentary material on which, for example, a second component substance is grafted chemically. If on the other hand, both the first component and the second component are granular, a mixture of the two may be dispersed in a fibrous or filamentary material, such as cellulose acetate, or may be disposed between first and second plugs of such material to provide a so-called triple-filter. Alternatively the mixture may be bonded, but not by a bonding agent which so surrounds the granules as to interfere with the adsorption—desorption—chemical reaction process of the filter.

EXAMPLE

Filtration efficiencies for total volatile aldehydes and for hydrogen cyanide were determined for cigarette-smoke filters each of which consisted of a mixture of porous granules of magnesium silicate (in the form of meerschaum) and Lewatit E 372/74 ion exchange resin in various proportions. The theoretical filtration efficiency for each filter was also calculated, use being made for this purpose of the relationship -

$$\phi = 1 - 10^{-KW}$$

where:

$\phi$ is the filtration efficiency, as a fraction, (F.E. %/100), for the smoke constituent K is a constant characteristic for the adsorbent and the smoke constituent adsorbed, and W is the weight of the adsorbent in grammes.

For a mixture of two adsorbents, the relationship becomes $$\phi = 1 - 10^{-K_1 W_1 - K_2 W_2}$$

where $K_1$ and $K_2$ are the respective constant characteristics and $W_1$ and $W_2$ are the respective weights.

The results determined are set out in the table below:

TABLE 1

| Composition (%) | | Filtration Efficiencies (%) | | | |
|---|---|---|---|---|---|
| | | Total Volatile Aldehydes | | Hydrogen Cyanide | |
| Lewatit | $MgSiO_3$ | Found | Theoretical | Found | Theoretical |
| 0 | 100 | 28 | 28 | 38 | 38 |
| 20 | 80 | 46 | 37 | 69 | 47 |
| 40 | 60 | 55 | 43 | 62 | 56 |
| 60 | 40 | 59 | 51 | 67 | 62 |
| 80 | 20 | 64 | 56 | 71 | 68 |
| 100 | 0 | 61 | 61 | 73 | 73 |

With all of the Lewatit/$MgSiO_3$ mixtures, irrespective of the composition, the measured filtration efficiencies were greater than the theoretical efficiencies for both total volatile aldehydes and hydrogen cyanide. A considerable synergistic effect was exhibited. A synergistic effect was also recorded when mixtures of Duolite GPA 327 and $MgSiO_3$ were similarly tested.

Table II sets out the filtration efficiencies obtained for total aldehydes using mixtures in various proportions of Lewatit E372/74 and Sorbsil ID Gel I:

TABLE II

| Composition (%) | | Filter Efficiencies (%) | |
|---|---|---|---|
| Lewatit | Sorbsil | Found | Theoretical |
| 0 | 100 | 22 | 22 |
| 20 | 80 | 42 | 32 |
| 40 | 60 | 54 | 41 |
| 60 | 40 | 55 | 49 |
| 80 | 20 | 61 | 55 |
| 100 | 0 | 61 | 61 |

Table III sets out similarly efficiencies found with mixtures in various proportions of Diaion CR 20 and Sepiolite:

TABLE III

| Composition (%) | | Filter Efficiencies | |
|---|---|---|---|
| Diaon | Sepiolite | Found | Theoretical |
| 0 | 100 | 28 | 28 |
| 20 | 80 | 53 | 37 |
| 40 | 60 | 60 | 47 |
| 60 | 40 | 61 | 58 |
| 80 | 20 | 69 | 66 |
| 100 | 0 | 75 | 75 |

The results set out in Tables II and III again show measured efficiencies greater than the calculated theoretical efficiencies.

Further comparitive tests were carried out using polyethylene imine and sepiolite as the first and second components respectively:

In the first test 7% by weight of polyethylene imine was evenly dispersed in a filter of paper. The filtration efficiency for total volatile aldehydes was measured and found to be 11%.

In a second test, use was made of a filter, of the same paper (without polyethylene imine), having a cavity which contained 36 mg of granular sepiolite. The efficiency for total volatile aldehydes was found to be 8%.

In a further test, 36 mg of sepiolite was evenly dispersed throughout a paper filter in which, as in the first test, 7% by weight of polyethylene imine had been dispersed. The measured efficiency was 30%. The theoretical efficiency calculated in the manner set out above would be 18%.

Thus a synergistic effect was clearly apparent also in this case.

We claim:

1. A tobacco-smoke filter comprising a first component which is a ready but weakly retentive absorbent for vapour-phase constituents, of the group consisting of aldehydes, and hydrogen cyanide, of tobacco smoke, and closely intermingled therewith a second component comprising amino groups as chemically active functional entities capable of forming strong bonds with said constituents to give substantially non-volatile reaction products.

2. A filter according to claim 1, wherein at least 30% of the amino groups of the second component are primary amino groups.

3. A filter according to claim 1, wherein the first component comprises a porous mineral earth.

4. A filter according to claim 1, wherein the first component comprises magnesium silicate in porous granular form.

5. A filter according to claim 4, wherein the first component comprises at least one substance of the group consisting of sepiolite.

6. A filter according to claim 1, wherein the first component comprises silica gel in porous granular form.

7. A filter according to claim 1, wherein the second component comprises an ion-exchange resin.

8. A filter according to claim 1, wherein the second component comprises polyethylene imine.

9. A filter according to claim 8, wherein the second component is carried upon a porous particulate material.

10. A filter according to claim 8, wherein the second component is carried upon a fibrous material.

11. A filter according to claim 1, wherein both the first and second components are granular and a mixture thereof is dispersed in a fibrous or filamentary material.

12. A filter according to claim 1, wherein the first component is granular and is dispersed in a fibrous material carrying the second material in a dispersed condition.

* * * * *